US005588706A

United States Patent [19]

Neumueller et al.

[11] Patent Number: 5,588,706

[45] Date of Patent: Dec. 31, 1996

[54] CONTROL MECHANISM FOR THE SEAT CARRIERS OF CHAIRS, ESPECIALLY SWIVEL CHAIRS

[75] Inventors: Maria Neumueller; Angelika Gebhard, both of Burgthann, Germany

[73] Assignee: Sifa Sitzfabrik GmbH, Sulzbach-Rosenberg, Germany

[21] Appl. No.: 322,994

[22] Filed: Oct. 14, 1994

[30] Foreign Application Priority Data

Oct. 14, 1993 [DE] Germany ..... 43 35 017.8

[51] Int. Cl.[6] ..... A47C 1/027

[52] U.S. Cl. ..... 297/374; 297/463.1

[58] Field of Search ..... 297/337, 374, 297/354.12, 354.1, 353, 463.1

[56] References Cited

U.S. PATENT DOCUMENTS

| | | | |
|---|---|---|---|
| 4,062,587 | 12/1977 | Wolters | 297/374 X |
| 4,198,094 | 4/1980 | Bjerknes et al. | 297/374 |
| 4,636,004 | 1/1987 | Neumuller | 297/374 |
| 5,066,869 | 11/1991 | DeGelder | 297/374 |
| 5,228,748 | 7/1993 | Neumuller | 297/374 |
| 5,356,200 | 10/1994 | Stumpf et al. | 297/337 X |

FOREIGN PATENT DOCUMENTS

| | | |
|---|---|---|
| 3212695 | 1/1983 | Germany . |
| 3424756 | 12/1983 | Germany . |
| 4014154 | 11/1991 | Germany . |
| 1544669 | 4/1979 | United Kingdom . |
| WO9014031 | 11/1990 | WIPO . |

*Primary Examiner*—Milton Nelson, Jr.
*Attorney, Agent, or Firm*—Morrison Law Firm

[57] ABSTRACT

A control mechanism for a seat carrier of a chair, especially a swivel chair. A pivotable part is clamped and released by lamellae with rotatably anchored ends. One set of ends is anchored without play; the other, with play. The ends anchored with play are suspended via holes from a clamping bolt which can slide, inside the clamping mechanism, against a spring that clamps the pivotable part. The lamellae are released by a control lever. The clamping bolt is slideably fitted in a pressure sleeve of diameter greater than the holes in the lamellae. The bolt behind the pressure sleeve has a stop that bears against the pressure sleeve during active clamping. On its other side this bolt passes through the wall at which the clamping action takes place. The outside of the clamping bolt, at a distance from this wall, has a mounting for a pressure spring that acts between the bolt and the wall. The pressure spring pushes the bolt outward, thus directing the clamping force to the lamellae. The control lever is pivotably mounted in a rigidly anchored support. A pressure nose of the control lever bears against the bolt head and moves the bolt transversely and horizontally toward the lamellae against the pressure spring.

12 Claims, 4 Drawing Sheets

CONTROL MECHANISM FOR THE SEAT CARRIERS OF CHAIRS, ESPECIALLY SWIVEL CHAIRS

BACKGROUND OF THE INVENTION

This invention relates to a control mechanism for the seat carrier of a chair, especially a swivel chair, in which a part that pivots in relation to a fixed part is clamped and released by means of urged lamellae rotatably anchored to one part without play and to another part with play, in which the locking force of the lamellar ends anchored with play pushes against a lateral inside wall of one of the parts, and in which the lamellae are released by means of at least one control lever acting against the locking force.

Control mechanisms for clamping lamellar stacks for adjusting the height of the seating surface and for adjusting the incline of the back rest of a swivel chair are known, for example, from German patent DE-U-75 16 743. In that apparatus the lamellar stacks are pushed against a wall of the seat carrier either by a threaded bolt with a tubular body or by an eccentric lever and a U.

A control mechanism for a seat carrier in which the clamping action and the release of a part that can be swivelled about a fixed part takes place by means of urged lamellae, each of which has one end anchored without play and another end rotatably anchored with play, and in which the locking force pushes the lamellar ends anchored with play to a lateral inside wall of one of the parts while the lamellae are released by at least one control lever acting against the locking force, is known from German patent DE 34 24 756 C2.

OBJECTS AND SUMMARY OF THE INVENTION

An object of the present invention is to devise a control mechanism for a seat carrier that is of simple design.

A further object of the present invention is to devise a control mechanism for a seat carrier that is easy to install.

Still a further object of the present invention is to devise a control mechanism for a seat carrier that is easily adapted for other functions.

Yet another object of the present invention is to devise a control mechanism for a seat carrier that is easy to operate.

These objectives are achieved by suspending, through holes from a clamping bolt, the lamellar ends that are anchored with play. These ends can slide, inside the part accommodating a clamping mechanism, horizontally and transversely toward the lamellae against a spring force that causes the locking force. On the side facing away from the side wall at which the clamping action takes place, a clamping bolt fits in a pressure sleeve whose diameter is greater than the holes of the lamellae. The clamping bolt can, especially when it is not tightly pulled over the pressure sleeve, fit behind the pressure sleeve with a stop, such as a nut which will, at least when the clamping mechanism is active, bear against the pressure sleeve. On its other side, the clamping bolt passes through the wall at which the clamping action takes place. The outside of the clamping bolt, at a distance from this wall, has a mounting for a pressure spring that acts between the clamping bolt and the wall. The pressure spring pushes the clamping bolt outward, thus directing the locking force, via the pressure sleeve connected to the clamping bolt, to the lamellae. A control lever, located outside the side wall through which the clamping bolt exits, is pivotably mounted in a support rigidly anchored to the wall. A pressure nose of the control lever bears against the bolt head. The control lever, as it moves about its swivel axis, moves the clamping bolt, against the force of the pressure spring, transversely and horizontally toward the lamellae.

In an advantageous embodiment of the invention, the support has an alignment hole for the clamping bolt and with lateral necks. The control lever surrounds the support laterally with two flaps directed toward the support. The control lever is rotatably mounted on the necks with recesses in the flaps.

Another advantage is that the mounting for the pressure spring at the end of the clamping bolt is or has a molded body. The molded body has either a slanted sliding surface for the pressure nose or a kinked design, that is, where the incline is followed by a vertical section. The pressure nose, after passing the kink, bears and locks against the vertical section, releasing the clamping mechanism.

In one embodiment of the invention, the clamping bolt with the pressure sleeve passes through the wall lying opposite the clamping action, and the pressure sleeve has lateral lugs. Pressure springs are clamped between the lugs and the wall. These pressure springs are together weaker than the pressure spring for the clamping mechanism.

In another embodiment of the invention, a pressure body lies between the wall at which the clamping action takes place and the lamellae. This pressure body is in one piece with the support and captively inserted in an opening of the associated wall.

The present invention allows a further advantageous embodiment, in which one seat carrier has two control mechanisms, each for a part that is pivotable in relation to the fixed part. One control mechanism is without a vertical section that makes the pressure nose abut and lock, while the other control mechanism is designed with such a section. In this embodiment, one function, e.g., adjusting the seat height, can be carried out only with the control lever. When it is released, the clamping mechanism is activated again immediately. The other function, e.g., adjusting the back rest, can either be carried out in the same manner or the associated clamping mechanism can be released completely, so that the the back rest can be in constant movement against a spring force.

Briefly stated, the present invention provides a control mechanism for a seat carrier of a chair, especially a swivel chair. A pivotable part is clamped and released by lamellae with rotatably anchored ends. One set of ends is anchored without play; the other, with play. The ends anchored with play are suspended via holes from a clamping bolt which can slide, inside the clamping mechanism, against a spring that clamps the pivotable part. The lamellae are released by a control lever. The clamping bolt is slideably fitted in a pressure sleeve of diameter greater than the holes in the lamellae. The bolt behind the pressure sleeve has a stop that bears against the pressure sleeve during active clamping. On its other side this bolt passes through the wall at which the clamping action takes place. The outside of the clamping bolt, at a distance from this wall, has a mounting for a pressure spring that acts between the bolt and the wall. The pressure spring pushes the bolt outward, thus directing the clamping force to the lamellae. The control lever is pivotably mounted in a rigidly anchored support. A pressure nose of the control lever bears against the bolt head and moves the bolt transversely and horizontally toward the lamellae against the pressure spring.

According to an embodiment of the invention, a clamping mechanism for a seat carrier of a chair comprises: a fixed part; a pivotable part; the pivotable part being clamped and released by means of lamellae; first ends of the lamellae being rotatably anchored to a one of the fixed and the pivotable parts without play; second ends of the lamellae being rotatably anchored to another of the parts with play; a locking force of the second ends pushing against a lateral inside wall of a one of the parts; the lamellae, when locked, being released by at least one control lever acting against the locking force; the second ends being suspended via holes from a clamping bolt that can slide, inside the clamping mechanism, horizontally and transversely toward the lamellae against a spring force that causes the locking force; the clamping bolt being fitted, on a side of the clamping mechanism opposite to a side at which clamping action takes place, into a pressure sleeve of a diameter greater than holes in the lamellae; the clamping bolt passing through the side at which the clamping action takes place; the clamping bolt having, outside the side at which the clamping action takes place and at a distance from the side, a mounting for a first pressure spring; the first pressure spring acting between the clamping bolt and the side at which the clamping action takes place to push the clamping bolt outward, thereby directing the locking force to the lamellae; the control lever being pivotably mounted, outside the side through which the clamping bolt passes, in a support rigidly anchored to the side; a pressure nose bearing against a head of the clamping bolt; and the control lever urging the clamping bolt transversely and horizontally toward the lamellae against the force of the first pressure spring.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
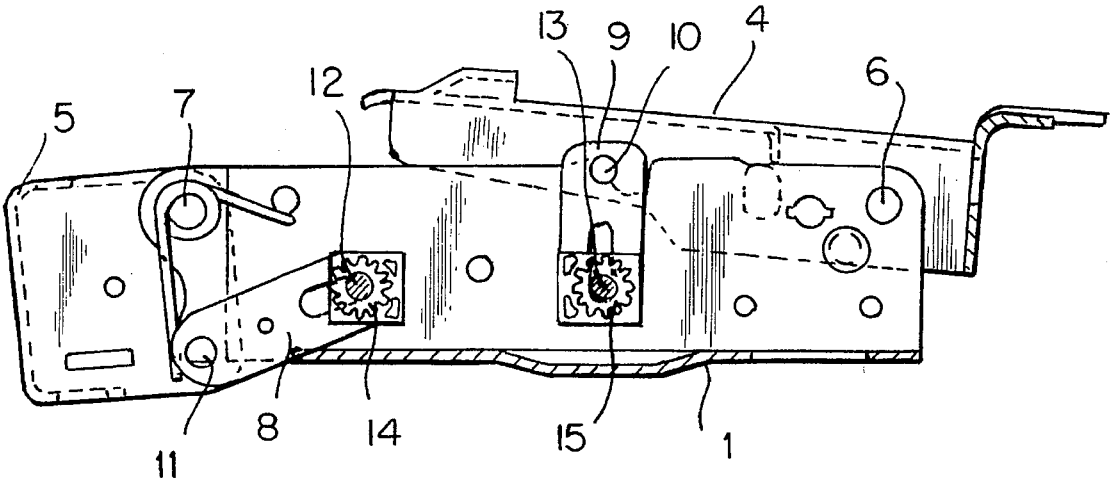
FIG. 1 is a lateral sectional view of a seat carrier of the present invention taken on the line I—I in FIG. 3.

Referring to FIG. 1, a seat carrier comprises a base 1, on which are pivotably mounted a seat plate carrier 4 and a back rest carrier 5. Seat plate carrier 4 is mounted on base 1 via a bolt 6; back rest carrier 5, via a second bolt 7. Between back rest carrier 5 and a rear section of base 1, a lamellar stack 8 is pivotably suspended without play on back rest carrier 5 by a retaining bolt 11. Lamellar stack 8 is pivotably suspended with play on base 1 by a clamping bolt 12. The clamping action of lamellar stack 8 takes place along the longitudinal axis of clamping bolt 12. Between seat plate carrier 4 and a forward section of base 1, a second lamellar stack 9 is pivotably suspended without play on seat plate carrier 4 by a retaining bolt 10, and with play on base 1 by a clamping bolt 13. The clamping action of second lamellar stack 9 takes place along the longitudinal axis of clamping bolt 13. Thus the seat carrier is provided with two separate clamping mechanisms: one for back rest carrier 5 and the other for seat plate carrier 4. Clamping bolts 12, 13 are respectively inside pressure sleeves 14, 15.

Figure 2:
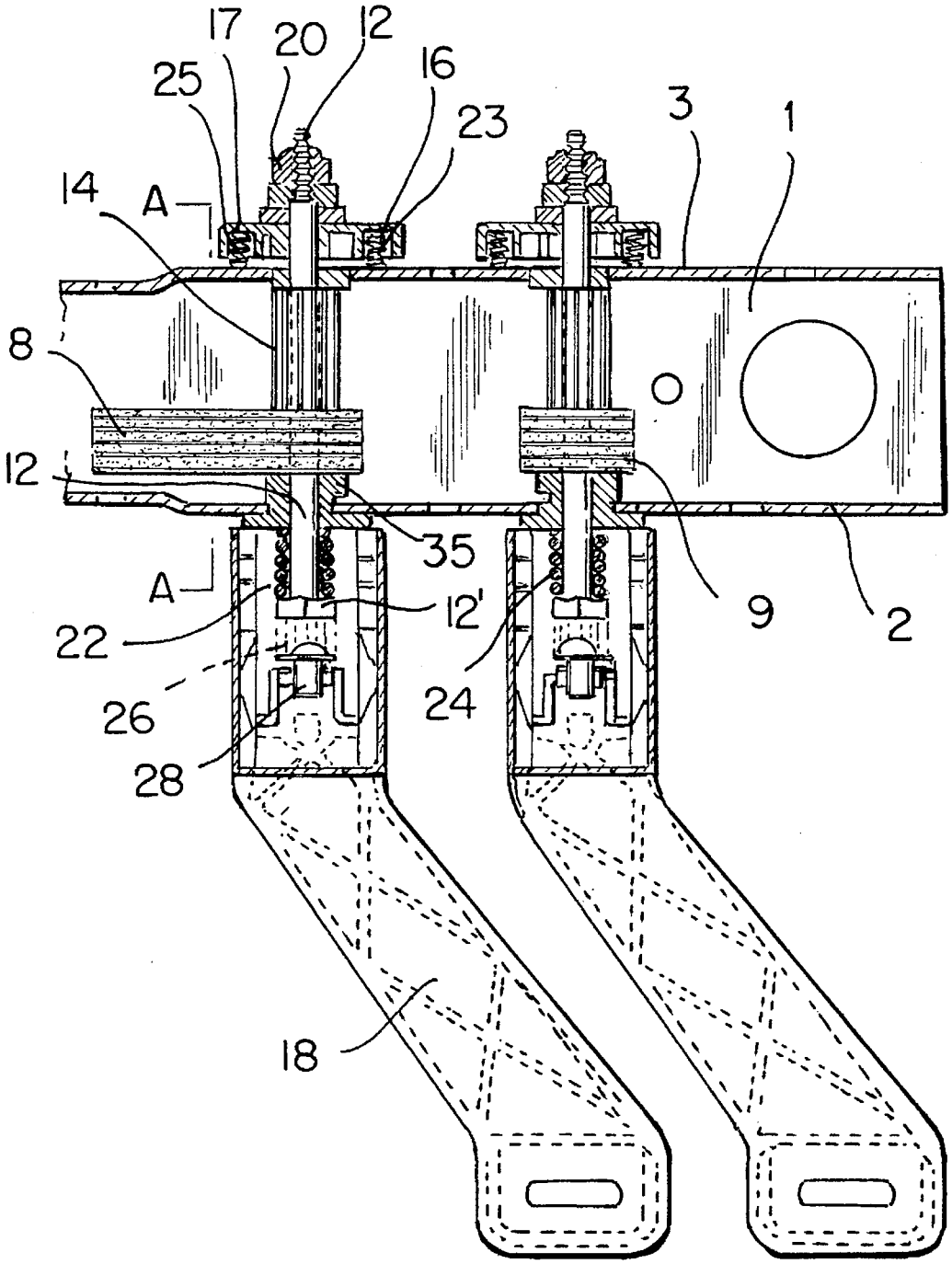
FIG. 2 is a top view of the base of the apparatus of FIG. 1.

Referring to FIG. 2, base 1 is U-shaped with side walls 2, 3. As the two clamping mechanisms are identical, the only difference between them is that lamellar stack 8 and second lamellar stack 9 serve to clamp different parts, as described above. It is therefore sufficient to describe only the rear clamping mechanism that uses lamellar stack 8, which locks the back rest carrier in position. Lamellar stack 8 lies between pressure sleeve 14 and a pressure body 35. Pressure sleeve 14 is force-fit to slide over clamping bolt 12, which also anchors lamellar stack 8. Pressure body 35, made in one piece that includes a support 22, is anchored in an opening of side wall 2 of base 1. Pressure body 35 and support 22 are provided with a hole in which clamping bolt 12 can slide in the axial direction.

Pressure sleeve 14 passes outward through side wall 3 of base 1 opposite the clamping mechanism, where it has two lateral lugs 16, 17 with recesses for pressure springs 23, 25, which act between lateral lugs 16, 17 and side wall 3. In the region where pressure sleeve 14 passes through side wall 3, pressure sleeve 15 and the opening are rectangular in shape, thereby providing torsional strength. Clamping bolt 12 projects beyond pressure sleeve 14, where it is provided with a thread to which a nut 20 is screwed. Turning nut 20 can adjust the clamping mechanism if necessary.

The force of pressure springs 23, 25 together is less than that of a pressure spring 24 against which the actual clamping force is applied. Pressure spring 24 acts outside side wall 2 opposite pressure sleeve 14 and clamping bolt 12. Clamping bolt 12 passes through side wall 2 and has a stop for pressure spring 24. Pressure spring 24 therefore tends to push clamping bolt 12 outward, thus applying a clamping force to lamellar stack 8 via pressure sleeve 14 and, possibly, nut 20. Pressure spring 24 is arranged inside a hole in support 22. As described below, a control lever 18 is pivotably fastened to support 22. Pressure nose 28 bears against a molded body 26, which is pulled over a bolt head 12'.

Figure 3:
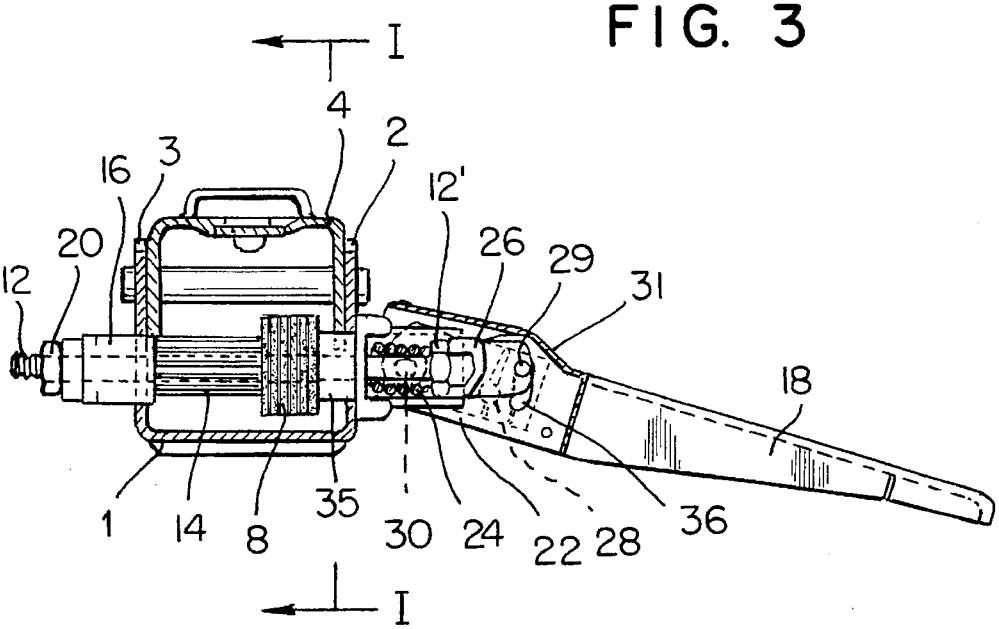
FIGS. 3 and 4 are frontal views through the base of FIG. 2 along section A—A.
Figure 4:
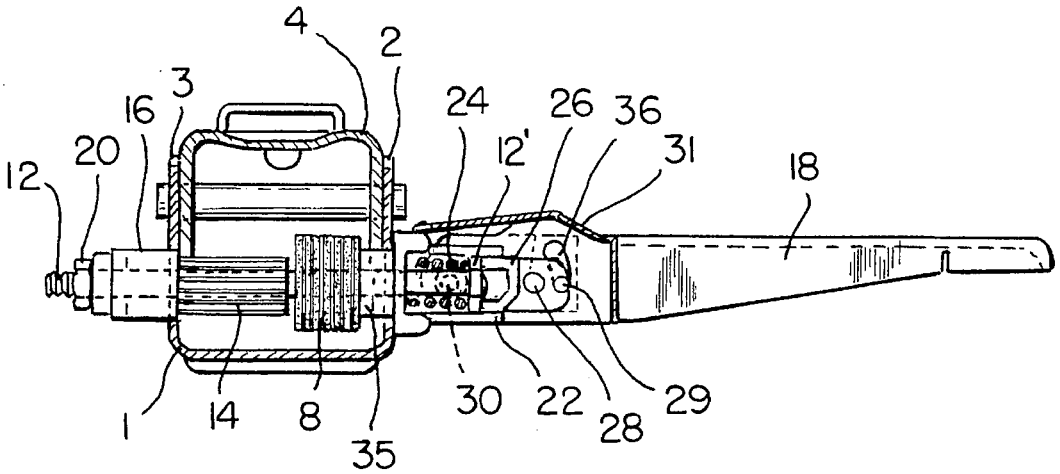

FIGS. 3 and 4 show the interaction between pressure nose 28 of control lever 18 and molded body 26. This frontal view (along section A—A of FIG. 2) shows base 1 with seat plate carrier 4. The clamping mechanism for lamellar stack 8 lies between side walls 2, 3 and comprises bolt 12, pressure sleeve 14 with its lug 16, nut 20, pressure body 35, and support 22. Control lever 18, which has a cover 31, is suspended from support 22 laterally in a neck 30 by two flaps 33, 33'. The swivel region of control lever 18 is bounded by a neck 29 on two projecting arms 22', 22" of support 22. Projecting arms 22', 22" engage grooves or slots: oblong holes 36 in flaps 33, 33' of control lever 18.

Figure 5:
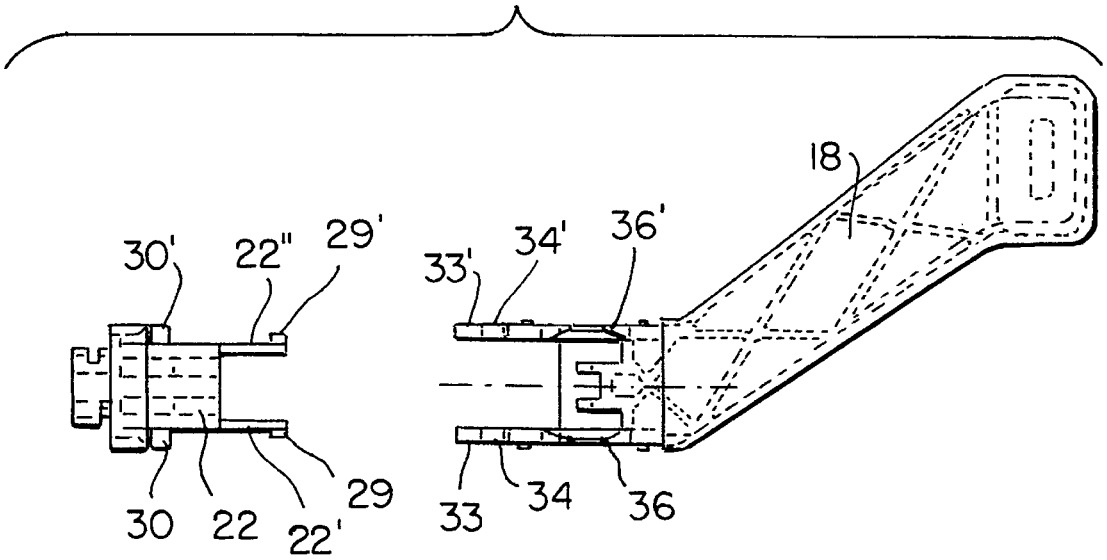
FIG. 5 is a top view of the control lever and the support of the apparatus of the present invention.

FIG. 5 shows in detail the interaction between control lever 18 and support 22. Flaps 33, 33' are directed toward support 22. Flaps 33, 33' have recesses 34, 34' that accommodate necks 30, 30' of support 22. Support 22 has two projecting arms 22', 22", at whose ends are arranged the outwardly directed necks 29, 29' for oblong holes 36, 36' in flaps 33, 33' of control lever 18. Molded body 26 has an inclined sliding surface with a kink and an adjacent vertical section.

Referring again to FIG. 4, pressure nose 28 of control lever 18 bears against the incline of molded body 26. Control lever 18 slants slightly downwards, and necks 29, 29' bear against the upper end of oblong holes 36, 36'. In this position, the clamping mechanism is adjusted so that a solid grip of the two mutually pivotable parts, in this case, base 1 and back rest carrier 5, is assured. Now, if control lever 18 is pulled up, pressure nose 28 slides along the incline of molded body 26. The clamping mechanism is released. If control lever 18 is moved further up, pressure nose 28 slides beyond the kink on molded body 26 and comes to bear against its vertical section, where it locks. Thus back rest carrier 5 remains released, and the user can rock the back rest, which is elastically pre-stressed in the direction of the user's back. If the back rest is to be fixed at a certain angle of incline, control lever 18 with its pressure nose 28 must be moved downward beyond the kink as soon as that angle is reached, whereupon it automatically slides into the clamping position.

Figure 6:
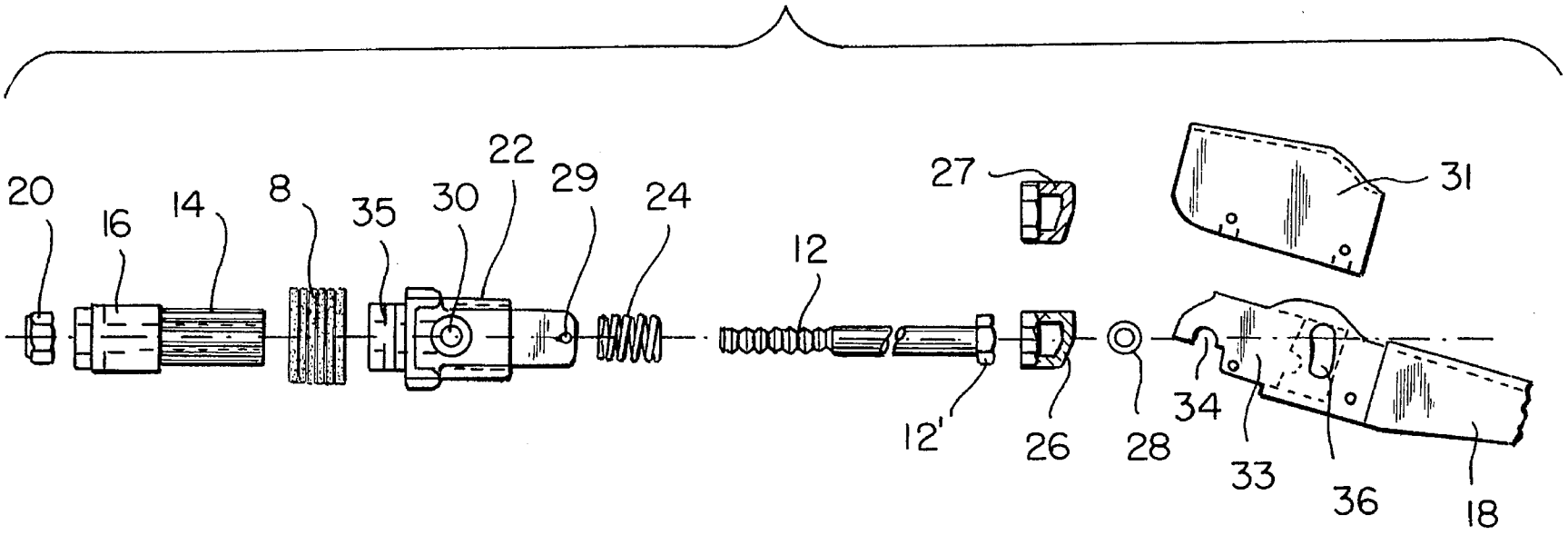
FIG. 6 is an exploded view of the clamping mechanism of the apparatus of the present invention without the base.

FIG. 6 shows an exploded view of the clamping mechanism. The parts through which clamping bolt 12 passes are shown on the left, beginning with nut 20, pressure sleeve 14 with its lugs 16, lamellar stack 8, support 22 with pressure body 35, necks 29 and 30, and pressure spring 24. One of the molded bodies, either molded body 26 or a molded body 27, must be pulled over clamping bolt head 12'. The difference between the molded bodies is that molded body 26 has a vertical section for lockably mounting pressure nose 28 of control lever 18, while molded body 27 has no vertical section. Here, pressure body 35 is designed as a bolt that is held between flaps 33, 33' of control lever 18. This facilitates making control lever 18 of plastic and pressure nose 28 of metal. Control lever 18, shown on the right, has, at its flaps 33, 33', which protrude toward support 22, recesses 34, 34' for rear necks 30, 30' of support 22, and oblong holes 36, 36' for frontal necks 29, 29' of support 22. Cover 31 shields the section where control lever 18 is connected to support 22.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A clamping mechanism for a seat carrier of a chair, comprising:

a fixed part;

a pivotable part;

said pivotable part being clamped and released by means of lamellae;

first ends of said lamellae being rotatably anchored to a one of said fixed and said pivotable parts without play;

second ends of said lamellae being rotatably anchored to another of said parts with play;

a locking force of said second ends pushing against a lateral inside wall of a one of said parts;

said lamellae, when locked, being released by at least one control lever acting against said locking force;

said lamellae second ends having holes through which pass a clamping bolt that can slide, inside said clamping mechanism, horizontally and transversely toward said lamellae against a spring force that causes said locking force;

said clamping bolt being fitted, on a first side of said clamping mechanism opposite to a second clamping mechanism side at which clamping action takes place, into a pressure sleeve of a diameter greater than a diameter of said lamellae second end holes;

said clamping bolt passing through said second mechanism side;

said clamping bolt having, outside said second mechanism side and at a distance from said second side, a first pressure spring and a mounting for said first pressure spring;

said first pressure spring acting between said clamping bolt and said second side to push said clamping bolt outward, thereby directing said locking force to said lamellae;

said control lever being pivotably mounted, outside said second side in a support rigidly anchored to said second side;

a pressure nose bearing against a head of said clamping bolt; and said control lever urging said clamping bolt transversely and horizontally toward said lamellae against the force of said first pressure spring, behind said pressure sleeve, said clamping bolt having a stop that bears against said pressure sleeve at least when said clamping mechanism is activated said support has an alignment hole for said clamping bolt and a pair of lateral necks;

said control lever surrounds said support with at least two flaps directed toward said support; and said control lever is rotatably mounted on said pair of lateral necks through recesses in said flaps.

2. Clamping mechanism according to claim 1, wherein a pressure body is located between said side at which clamping action takes place and said lamellae.

3. Clamping mechanism according to claim 1, wherein:

said clamping bolt and said pressure sleeve pass through said first side opposite said clamping mechanism;

said pressure sleeve has a plurality of lateral lugs;

between said lugs and said first side, at least two pressure springs are clamped in; and said at least two pressure springs together exert a force less than that of said first pressure spring.

4. Clamping mechanism according to claim 3, wherein a pressure body is located between said side at which clamping action takes place and said lamellae.

5. Clamping mechanism according to claim 3, wherein:

a pressure body is formed integrally in one piece with said support; and said one piece is captively inserted in an opening of an associated side.

6. Clamping mechanism according to claim 5, wherein said pressure body is located between said side at which clamping action takes place and said lamellae.

7. Clamping mechanism according to claim 1, wherein:

said mounting for said first pressure spring is a molded body; and said molded body has a slanted sliding surface for said pressure nose.

8. Clamping mechanism according to claim 7, further comprising:

a second like clamping mechanism adapted to be located on the seat carrier;

each of said two clamping mechanisms being associated with a part that is pivotable in relation to said fixed part;

a one of said two clamping mechanisms being constructed without a vertical section that makes said pressure nose abut and lock; and another of said two clamping mechanisms being constructed with said vertical section.

9. Clamping mechanism according to claim 7, wherein:

said sliding surface has a kink, so that its incline is followed by a vertical section; and said pressure nose, after passing said kink, bears against and locks said vertical section, thereby releasing said clamping mechanism.

10. Clamping mechanism according to claim 9, wherein a pressure body is located between stud side at which clamping action takes place and said lamellae.

11. Clamping mechanism according to claim 9, further comprising:

a second like clamping mechanism adapted to be located on the seat carrier;

each of said two clamping mechanisms being associated with a part that is pivotable in relation to said fixed part;

a one of said two clamping mechanisms being constructed without a vertical section that makes said pressure nose abut and lock; and another of said two clamping mechanisms being constructed with said vertical section.

12. Clamping mechanism according to claim 7, wherein a pressure body is located between said side at which clamping action takes place and said lamellae.

* * * * *